US010184647B2

(12) United States Patent
Zhang

(10) Patent No.: US 10,184,647 B2
(45) Date of Patent: Jan. 22, 2019

(54) LIGHTING CONNECTION STRUCTURE

(71) Applicant: GARDENIA INDUSTRIAL LIMITED, Tortola (VG)

(72) Inventor: YanXu Zhang, Zhong Shan (CN)

(73) Assignee: Gardenia Industrial Limited, Road Town, Tortola (VG)

( * ) Notice: Subject to any disclaimer, the term of this patent is extended or adjusted under 35 U.S.C. 154(b) by 0 days.

(21) Appl. No.: 15/723,865

(22) Filed: Oct. 3, 2017

(65) Prior Publication Data

US 2018/0149345 A1 May 31, 2018

(30) Foreign Application Priority Data

Nov. 25, 2016 (CN) ..... 2016 2 1282118 U

(51) Int. Cl.

| | |
|---|---|
| ***F21V 23/00*** | (2015.01) |
| ***F21V 23/06*** | (2006.01) |
| ***F21S 4/00*** | (2016.01) |
| ***F21V 21/002*** | (2006.01) |
| *F21Y 115/10* | (2016.01) |
| *F21Y 105/18* | (2016.01) |

(52) U.S. Cl.

CPC ..... *F21V 23/002* (2013.01); *F21S 4/00* (2013.01); *F21V 21/002* (2013.01); *F21V 23/003* (2013.01); *F21V 23/008* (2013.01); *F21V 23/06* (2013.01); *F21Y 2105/18* (2016.08); *F21Y 2115/10* (2016.08)

(58) Field of Classification Search

CPC ..... F21V 23/002; F21V 21/002; F21V 23/00; F21V 23/003; F21V 23/008; F21V 23/06; F21S 4/00

See application file for complete search history.

(56) References Cited

U.S. PATENT DOCUMENTS

2008/0205059 A1* 8/2008 Tsuji ..... F21V 21/002 362/249.01

* cited by examiner

*Primary Examiner* — Anne M Hines

(74) *Attorney, Agent, or Firm* — Lewis Roca Rothgerber Christie LLP

(57) ABSTRACT

A lamp including a lamp body, a light source plate in the lamp body, a light source on the light source plate, and a connection structure configured to electrically connect a power supply to the light source. The connection structure includes a wiring groove defined in a bottom of the lamp body, an electrode pin electrically coupled to the light source and extending into the wiring groove, and a wire fastener coupled to the bottom of the lamp body. The wire fastener is configured to move between open and closed positions. When the power supply line is in the wiring groove and the wire fastener is moved into the closed position, the wire fastener presses the power supply line toward the electrode pin and causes the electrode pin to pierce the power supply line to electrically couple the power supply line to the light source via the electrode pin.

7 Claims, 5 Drawing Sheets

LIGHTING CONNECTION STRUCTURE

CROSS-REFERENCE TO RELATED APPLICATION

The present application claims priority to and the benefit of Chinese Application No. 201621282118.9, filed on Nov. 25, 2016, the entire content of which is incorporated herein by reference.

FIELD

The present disclosure relates generally to lamps and lamp connection structures.

BACKGROUND

Lighting units are commonly installed along the bottoms of kitchen cabinets to provide lighting to the kitchen counters below the cabinets. With related art multi-head cabinet lights, the distance between adjacent lights must be measured or determined accurately to facilitate the installation of the lights and the connection of the lights to a power source. However, the spacing between adjacent lights is difficult to control and therefore deviations in the distances between adjacent lights are common, which makes installation of the lights time-consuming and cumbersome. Additionally, with related art lights, the power source is typically connected to the lights by welding, manual winding of wires and/or crimping, which are time-consuming techniques. Accordingly, fast connection between the power source and the lights is not feasible with related art lights and installation techniques.

SUMMARY

The present disclosure is directed to various embodiments of a lamp. In one embodiment, the lamp includes a lamp body, a light source plate in the lamp body, a light source on the light source plate, and a connection structure configured to electrically connect a power supply to the light source. The connection structure includes a wiring groove defined in a bottom of the lamp body, an electrode pin electrically coupled to the light source and extending into the wiring groove, and a wire fastener coupled to the bottom of the lamp body. The wire fastener is configured to move between an open and closed position. When the power supply line is in the wiring groove and the wire fastener is moved into the closed position, the wire fastener presses the power supply line toward the electrode pin and causes the electrode pin to pierce the power supply line to electrically couple the power supply line to the light source via the electrode pin.

The lamp body may include a lamp housing, a lamp cover connected to the lamp housing, and a holder fixedly connected to the lamp housing by a screw. The wiring groove may be located at a bottom of the holder and the light source plate may be located at a top of the holder. The electrode pin may pass through the light source plate and the holder and extend into the wiring groove.

A first end of the wire fastener may be hingedly connected to the bottom of the holder and a second end of the wire fastener may include a latch detachably connected to a catch on the bottom of the holder when the wire fastener is in the closed position. The first end of the wire fastener and the catch may be on opposite sides of the wiring groove such that the wire fastener in the closed position extends across the wiring groove.

The electrode pin may include a positive electrode pin and a negative electrode pin configured to electrically connect to a positive electrode and a negative electrode, respectively, of the power supply line. The positive electrode pin and the negative electrode pin may each include a sharp bottom portion in the wiring groove.

The lamp body may include a pair of opposing attachment flanges connected to a lower end of the lamp housing. Each attachment flange of the pair of opposing attachment flanges may define a through hole.

The light source on the light source board may be an LED light source.

The present disclosure is also directed to various embodiments of a system. In one embodiment, the system includes a power supply line configured to be connected to a power supply, and a lamp. The lamp includes a lamp body, a light source plate in the lamp body, a light source on the light source plate, and a connection structure configured to electrically connect a power supply to the light source. The connection structure includes a wiring groove defined in a bottom of the lamp body, an electrode pin electrically coupled to the light source and extending into the wiring groove, and a wire fastener coupled to the bottom of the lamp body. The wire fastener is configured to move between an open and closed position. When the power supply line is in the wiring groove and the wire fastener is moved into the closed position, the wire fastener presses the power supply line toward the electrode pin and causes the electrode pin to pierce the power supply line to electrically couple the power supply line to the light source via the electrode pin.

The system may also include a driver and a plug connected to the driver. An output end of the driver is connected to the power supply line.

The driver my include a driver housing including an upper shell and a lower shell coupled to the upper shell, and a power supply board within the driver housing.

This summary is provided to introduce a selection of concepts that are further described below in the detailed description. This summary is not intended to identify key or essential features of the claimed subject matter, nor is it intended to be used in limiting the scope of the claimed subject matter. One or more of the described features may be combined with one or more other described features to provide a workable device.

BRIEF DESCRIPTION OF THE DRAWINGS

The accompanying drawings, together with the specification, illustrate exemplary embodiments of the present disclosure, and, together with the description, serve to explain the principles of the present disclosure.

DETAILED DESCRIPTION

The present disclosure is directed to various embodiments of a lamp including a lamp connection structure configured to facilitate readily attaching the lamp to a power source. The present disclosure is also directed to various embodiments of a system including a power supply connected to a lamp by a lamp connection structure of the lamp. The lamps of the present disclosure may be installed in any desired location, such as, for instance, under kitchen cabinets to provide directional lighting to a kitchen counter.

Figure 1:
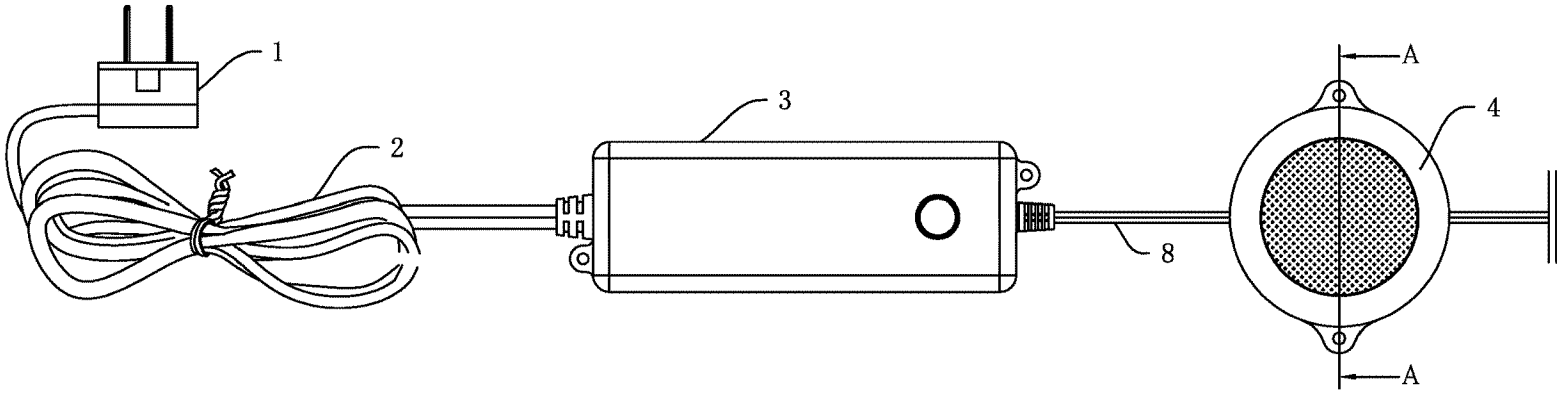
FIG. 1 is a schematic diagram of a system including a plug, a driver, a power supply line, and a lamp including lamp connection structure for electrically connecting the lamp to the power supply line according to one embodiment of the present disclosure.

With reference now to FIG. 1, a system according to one embodiment of the present disclosure includes a plug 1 (e.g., a quick-connector), a wire 2 connected to the plug 1, a driver 3 connected to an end of the wire 2 opposite the plug 1, a power supply line 8 connected to an output end of the driver 3, and a lamp 4 connected to the power supply line 8. As described in more detail below, the power supply line 8 is electrically coupled to the lamp 4 by a lamp connection structure provided at a bottom of the lamp 4.

Figure 2A:
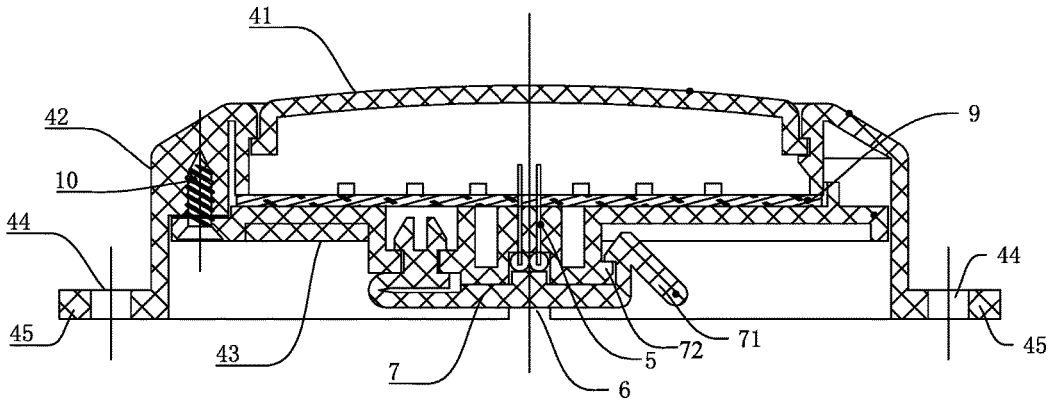
FIGS. 2A-2C are a cross-sectional view of the embodiment of the lamp illustrated in FIG. 1 taken along line A-A, a perspective view of the lamp with the lamp connection structure in an open position, and a perspective view of the lamp with the lamp connection structure in a closed position, respectively.
Figure 3:
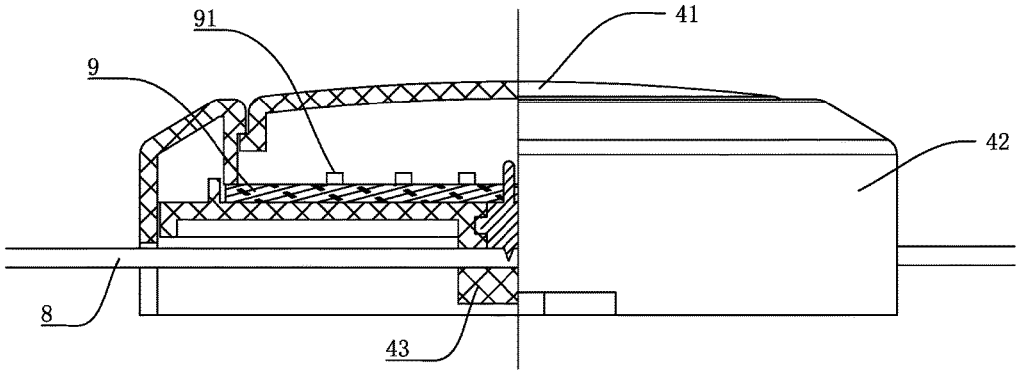
FIG. 3 is a partial cross-sectional view of the embodiment of the lamp illustrated in FIG. 2A.
Figure 2B:
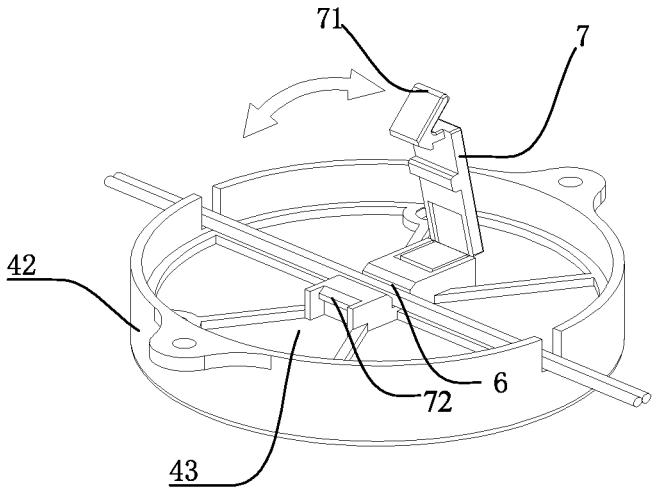
Figure 2C:
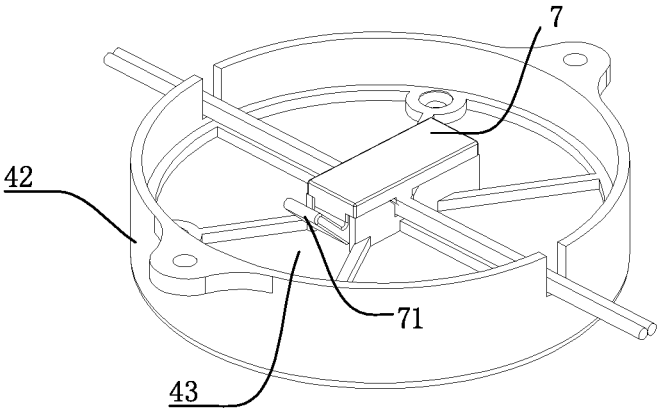

With reference now to FIGS. 2A-3, the lamp 4 according to one embodiment of the present disclosure includes a lamp housing 42, a lamp cover 41 (e.g., a translucent or transparent cover) coupled to the lamp housing 42, and a holder 43 (e.g., a seat or a base) coupled to the lamp housing 42. In the illustrated embodiment, the lamp cover 41 is opposite to the lamp holder 43 and the lamp cover 41 and the lamp holder 43 define a cavity therebetween. In the illustrated embodiment, the holder 43 is fixedly connected to the lamp housing 42 by a screw 10 connected to an upper portion of the lamp housing 42, although in one or more embodiments the holder 43 may be connected to the lamp housing 42 by any other suitable mechanism.

Figure 4:
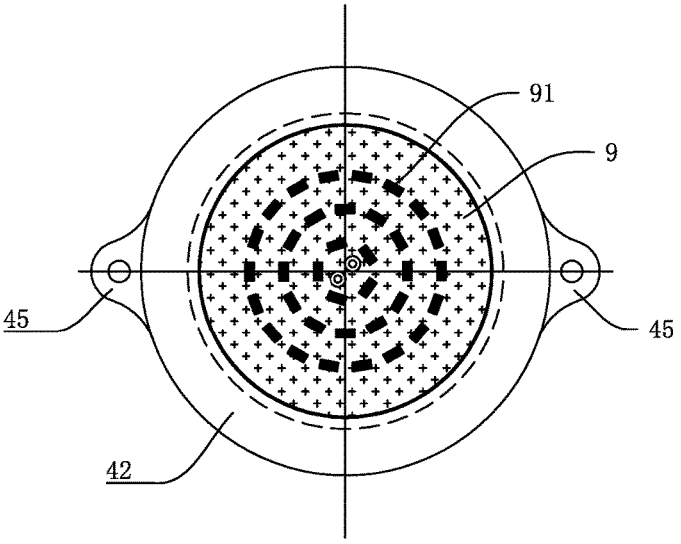
FIG. 4 is a top view of the embodiment of the lamp illustrated in FIGS. 1-3.

With continued reference to the embodiment illustrated in FIGS. 2A-3, the lamp 4 includes a light source plate 9 in the cavity and on the holder 43 (e.g., supported on an upper surface of the holder 43). In the illustrated embodiment, the wiring groove 6 is located at the bottom of the holder 43 and the light source plate 9 is located at the top of the holder 43 (i.e., the wiring groove 6 and the light source plate 9 are located on opposite sides of the holder 43). The light source plate 9 supports one or more light-producing elements. In the embodiment illustrated in FIGS. 3 and 4, the light source plate 9 supports an LED light source 91. The LED light source 91 may include a series of LEDs uniformly arranged in concentric rings configured to produce substantially uniform light, as illustrated in FIG. 4.

In the illustrated embodiment, a wiring groove 6 (e.g., a channel or a trough) is defined in a lower end (e.g., bottom) end of the holder 43. As described in more detail below, the wiring groove 6 is configured to accommodate the power supply line 8 to electrically connect the power supply line 8 to the LED light source 91.

In the illustrated embodiment, the lamp 4 also includes at least one electrode pin 5 electrically connected to LED light source 91 supported on the light source plate 9. The electrode pin 5 extends through the light source plate 9 and the holder 43 and into the wiring groove 6. The electrode pin 5 is configured to electrically connect the power supply line 8 to the LED light source 91. The electrode pin 5 may be made of any electrically conductive material, such as copper. In the illustrated embodiment, the at least one electrode pin 5 includes a positive electrode pin and a negative electrode pin configured to electrically connect to positive and negative electrode lines, respectively, in the power supply line 8. In one or more embodiments, each of the electrode pins 5 includes a pointed or sharp bottom portion in the wiring groove 6 configured to facilitate piercing of the power supply line 8.

The lamp 4 also includes a lamp connection structure for forming the electrical connection between the at least one electrode pin 5 and the LED light source 91. The lamp connection structure is also configured to secure the power supply line 8 in the wiring groove 6. In the embodiment illustrated in FIGS. 2A-2C, the lamp connection structure includes a wire fastener 7 coupled to the bottom end of the holder 43. The wire fastener 7 is configured to move between an open position and a closed position. In the open position, the power supply line 8 may be inserted into the wiring groove 6. In the illustrated embodiment, the wire fastener 7 is a buckle including a first end hingedly coupled to the bottom end of the holder 43. The first end of the wire fastener 7 may be hingedly coupled to the holder 43 by a live hinge or any other suitable type or kind of hinge mechanism. In the illustrated embodiment, the wire fastener 7 is configured to rotate between the closed and open positions about the live hinge at the first end of the wire fastener 7. Additionally, in the illustrated embodiment, the wire fastener 7 (or at least a portion thereof) is formed of a flexible and resilient material configured to facilitate rotation of the wire fastener 7 between the open and closed positions. A second end of the wire fastener 7 opposite to the first end includes a latch 71 (e.g., a barb). The latch 71 of the wire fastener 7 is configured to detachably engage a catch 72 at the bottom end of the holder 43 when the wire fastener 7 is in the closed position. In the illustrated embodiment, the first end of the wire fastener 7 that is hingedly coupled to the holder 43 and the catch 72 are on opposite sides of the wiring groove 6. Accordingly, when the wire fastener 7 is in the closed position, the wire fastener 7 spans across the wiring groove 6, which serves to retain the power supply line 8 in the wiring groove 6. In one or more embodiments, the wiring fastener 7 may have any other suitable configuration, such as, for instance, a crimping pin (e.g., a snap).

In the illustrated embodiment in FIGS. 2A and 4, the lamp 4 also includes a pair of opposing attachment flanges 45 (e.g., ears) connected to a bottom portion of the lamp housing 42. Each of the attachment flanges 45 defines a through 44 configured to receive a fastener (e.g., a locking screw) for securing the lamp 4 to a structure, such as a cabinet or a mounting plate.

Figure 6:
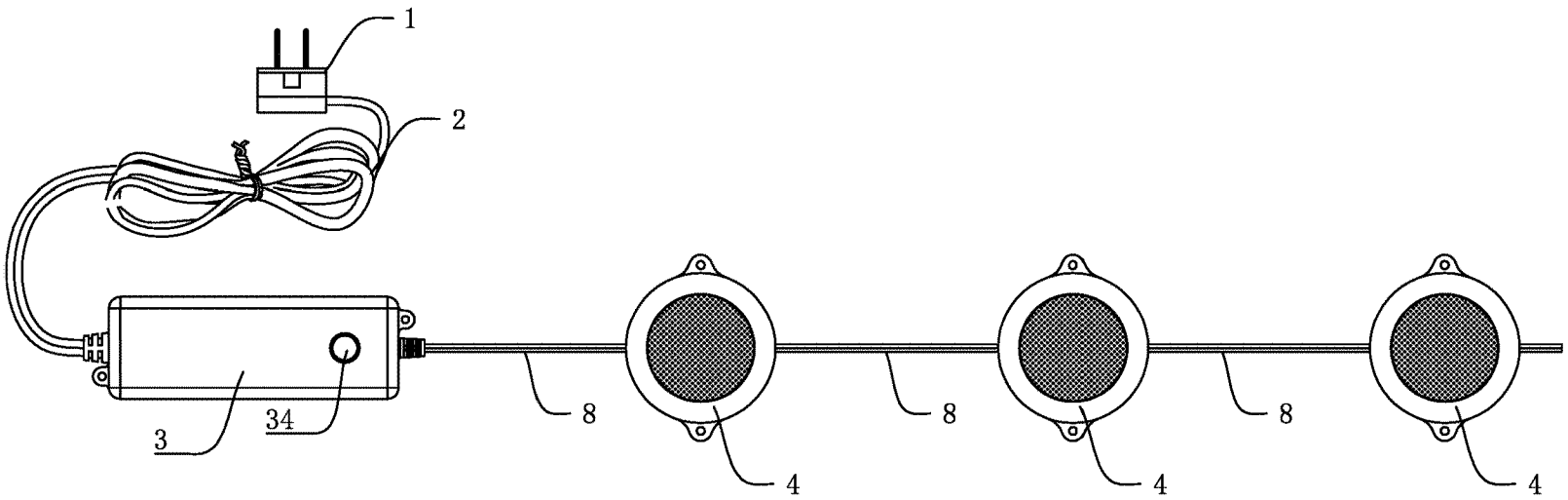
FIG. 6 is a schematic view of a multi-lamp installation including a series of lamps electrically coupled to a power supply line according to one embodiment of the present disclosure.

To electrically couple the power supply line 8 to the LED lights 91 in the lamp 4, the wire fastener 7 is first moved to the open position (e.g., by rotating the wire fastener 7 about the first end of the wire fastener 7 into the open position). The power supply line 8 may then be inserted into the wiring groove 6 defined in the lower end of the holder 43 of the lamp 4. The wire fastener 7 may then be moved to the closed position (e.g., by rotating the wire fastener 7 about the first end of the wire fastener 7 into the closed position). As the wire fastener 7 is moved into the closed position, the wire fastener 7 engages the power supply line 8 and presses it further into the wiring groove 6 toward the electrode pin 5, which causes the electrode pin 5 to pierce the power supply line 8. In the illustrated embodiment, the power supply line 8 may be positioned (e.g., oriented) in the wiring groove 6 such that the negative electrode pin and the positive electrode pin of the electrode pin 5 are aligned with, and configured to pierce, the negative and positive electrode lines, respectively, of the power supply line 8. Piercing the power supply line 8 with the electrode pin 5 electrically couples the power supply line 8 to the LED light source 91 on the light source plate 9. Additionally, when the wire fastener 7 is in the closed position (e.g., the latch 71 at the second end of the wire fastener 7 engages the catch 72 at the bottom of the holder 43), the wire fastener 7 spans across the wiring groove 6 and thereby retains (e.g., secures) the power supply line 8 in the wiring groove 6. In this manner, a series of lamps 4 may be readily attached to the power supply line 8 at desired intervals (e.g., regularly or irregularly spaced) along the span of the power supply line 8 to achieve a multi-lamp installation, as shown, for instance, in FIG. 6, utilizing the lamp connection structure (e.g., the wire fastener 7) of each lamp 4. Connecting the lamps 4 to the power supply 8 in this manner is simpler, more convenient, and more reliable than related art lamp systems.

Figure 5:
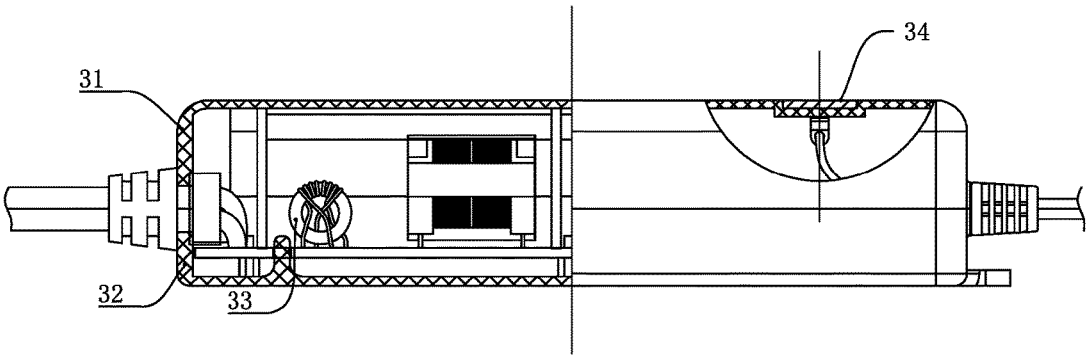
FIG. 5 is a partial cross-sectional view of the embodiment of the driver illustrated in FIG. 1.

With reference now to the embodiment illustrated in FIG. 5, the driver 3 includes a driver housing having an upper housing shell 31 (e.g., an upper case) and a lower housing shell 32 (e.g., a lower case) coupled to the upper housing shell 31. A power supply board 33 is housed in the driver housing of the driver 3. The power supply board 33 includes a driving integrated circuit (e.g., a power supply circuit). In the illustrated embodiment, driver 3 also includes a switch or a button 34 at the upper housing shell 31 electrically connected to the power supply board 33. The switch or button 34 is configured to control the power output of the driver 3 (e.g., the switch or button 34 is configured to turn the driver 3 on and off).

While this invention has been described in detail with particular reference to exemplary embodiments thereof, the exemplary embodiments described herein are not intended to be exhaustive or to limit the scope of the invention to the exact forms disclosed. Persons skilled in the art and technology to which this invention pertains will appreciate that alterations and changes in the described structures and methods of assembly and operation can be practiced without meaningfully departing from the principles, spirit, and scope of this invention, as set forth in the following claims, and equivalents thereof.

What is claimed is:

1. A lamp comprising:
a lamp housing;
a lamp cover coupled to the lamp housing; and
a holder coupled to the lamp housing;
a light source plate on a top of the holder;
a light source on the light source plate; and
a connection structure configured to electrically connect a power supply line to the light source, the connection structure comprising:
a wiring groove defined in a bottom of the holder;
an electrode pin electrically coupled to the light source, the electrode pin passing through the light source plate and the holder and extending into the wiring groove; and
a wire fastener coupled to the bottom of the holder, the wire fastener configured to move between an open position and a closed position,
wherein a first end of the wire fastener is hingedly connected to the bottom of the holder and a second end of the wire fastener comprises a latch detachably connected to a catch on the bottom of the holder when the wire fastener is in the closed position,
wherein the first end of the wire fastener and the catch are on opposite sides of the wiring groove such that the wire fastener in the closed position extends across the wiring groove, and
wherein when the power supply line is in the wiring groove and the wire fastener is moved into the closed position, the wire fastener presses the power supply line toward the electrode pin and causes the electrode pin to pierce the power supply line to electrically couple the power supply line to the light source via the electrode pin.

2. The lamp of claim 1, wherein the electrode pin comprises a positive electrode pin and a negative electrode pin configured to electrically connect to a positive electrode and a negative electrode, respectively, of the power supply line, and wherein each of the positive electrode pin and the negative electrode pins comprises a sharp bottom portion in the wiring groove.

3. The lamp of claim 1, wherein the lamp further comprises a pair of opposing attachment flanges connected to a lower end of the lamp housing, and wherein each of the pair of opposing attachment flanges defines a through hole.

4. The lamp of claim 1, wherein the light source on the light source plate comprises an LED light source.

5. A system comprising:
a power supply line configured to be connected to a power supply; and
a lamp comprising:
a lamp housing;
a lamp cover coupled to the lamp housing;
a holder coupled to the lamp housing;
a light source plate on a top of the holder;
a light source on the light source plate; and
a connection structure configured to electrically connect a power supply line to the light source, the connection structure comprising:
a wiring groove defined in a bottom of the holder, and
an electrode pin electrically coupled to the light source, the electrode pin passing through the light source plate and the holder and extending into the wiring groove; and
a wire fastener coupled to the bottom of the holder, the wire fastener configured to move between an open position and a closed position,
wherein a first end of the wire fastener is hingedly connected to the bottom of the holder and a second end of the wire fastener comprises a latch detachably connected to a catch on the bottom of the holder when the wire fastener is in the closed position,
wherein the first end of the wire fastener and the catch are on opposite sides of the wiring groove such that the wire fastener in the closed position extends across the wiring groove, and
wherein when the power supply line is in the wiring groove and the wire fastener is moved into the closed position, the wire fastener presses the power supply line toward the electrode pin and causes the electrode pin to pierce the power supply line to electrically couple the power supply line to light source via the electrode pin.

6. The system of claim 5, further comprising a driver and a plug connected to the driver, wherein an output end of the driver is connected to the power supply line.

7. The system of claim 6, wherein the driver comprises a driver housing comprising an upper shell and a lower shell coupled to the upper shell, and a power supply board within the driver housing.

* * * * *